US009156046B2

(12) United States Patent
Jerdee et al.

(10) Patent No.: US 9,156,046 B2
(45) Date of Patent: Oct. 13, 2015

(54) PLURAL COMPONENT SYSTEM HEATER

(71) Applicant: Wagner Spray Tech Corporation, Plymouth, MN (US)

(72) Inventors: Jeffrey Scott Jerdee, Brooklyn Park, MN (US); Shawn Cameron Johnson, Milaca, MN (US)

(73) Assignee: WAGNER SPRAY TECH CORPORATION, Plymouth, MN (US)

( * ) Notice: Subject to any disclaimer, the term of this patent is extended or adjusted under 35 U.S.C. 154(b) by 229 days.

(21) Appl. No.: 13/835,428

(22) Filed: Mar. 15, 2013

(65) Prior Publication Data

US 2014/0209703 A1 Jul. 31, 2014

Related U.S. Application Data

(60) Provisional application No. 61/756,783, filed on Jan. 25, 2013.

(51) Int. Cl.

| | |
|---|---|
| ***B05B 1/24*** | (2006.01) |
| ***B05B 7/16*** | (2006.01) |
| ***B05B 7/22*** | (2006.01) |
| ***B26D 3/00*** | (2006.01) |
| ***F24H 1/12*** | (2006.01) |
| ***F24H 9/18*** | (2006.01) |
| ***F28F 7/02*** | (2006.01) |

(Continued)

(52) U.S. Cl.

CPC ..... *B05B 7/1693* (2013.01); *B05B 7/0093* (2013.01); *B05B 7/22* (2013.01); *B26D 3/00* (2013.01); *F24H 1/121* (2013.01); *F24H 9/1818* (2013.01); *F28F 7/02* (2013.01); *B05B 7/02* (2013.01); *F28F 2255/16* (2013.01); *Y10T 83/0596* (2015.04)

(58) Field of Classification Search

CPC ..... B05B 1/24; B05B 7/16; B05B 7/08
USPC ..... 239/548, 549, 554, 566, 565, 552, 128, 239/133, 135, 137
See application file for complete search history.

(56) References Cited

U.S. PATENT DOCUMENTS

| | | | | |
|---|---|---|---|---|
| 2,657,097 | A * | 10/1953 | New | 239/135 |
| 4,501,952 | A | 2/1985 | Lehrke | |
| 4,667,084 | A | 5/1987 | Regge | |

(Continued)

FOREIGN PATENT DOCUMENTS

| | | | |
|---|---|---|---|
| DE | 9111152 | U1 | 10/1992 |
| DE | 102009038762 | A1 | 3/2011 |

(Continued)

OTHER PUBLICATIONS

Application and Drawings for U.S. Appl. No. 61/737,591 dated Dec. 14, 2012, 43 pages.

(Continued)

*Primary Examiner* — Davis Hwu
(74) *Attorney, Agent, or Firm* — Christopher J. Volkmann; Kelly, Holt & Christenson, PLLC

(57) ABSTRACT

An exemplary plural component heater assembly includes a plurality of heater modules each having a plurality of bores forming at least a first component path and a second component path, and at least one heating element receptacle configured to receive a heating element for heating the first and second component paths.

19 Claims, 22 Drawing Sheets

(51) Int. Cl.
*B05B 7/00* (2006.01)
*B05B 7/02* (2006.01)

(56) References Cited

U.S. PATENT DOCUMENTS

| | | | | |
|---|---|---|---|---|
| 5,724,478 | A * | 3/1998 | Thweatt | 392/484 |
| 5,872,890 | A | 2/1999 | LaCombe | |
| 5,988,521 | A * | 11/1999 | Nohynek | 239/11 |
| 6,330,395 | B1 | 12/2001 | Wu | |
| 7,822,326 | B2 | 10/2010 | Commette et al. | |
| 8,249,437 | B2 | 8/2012 | Commette et al. | |
| 8,313,042 | B2 * | 11/2012 | Vanderzwet | C23C 24/04 219/221 |
| 2011/0286724 | A1 | 11/2011 | Goodman | |
| 2012/0282121 | A1 | 11/2012 | Kieffer et al. | |
| 2012/0321285 | A1 | 12/2012 | Scherer | |
| 2014/0166775 | A1 | 6/2014 | Courier | |
| 2014/0209703 | A1 | 7/2014 | Jerdee et al. | |

FOREIGN PATENT DOCUMENTS

| | | | |
|---|---|---|---|
| EP | 0454550 | A1 | 10/1991 |
| EP | 0492766 | A2 | 7/1992 |
| WO | 2005078355 | A1 | 8/2005 |

OTHER PUBLICATIONS

Search Report and Written Opinion for International Application No. PCT/US2014/012441. 11pages.

REACTOR, Electric, Heated, Plural Component Proportioner for spraying polyurethane foam and polyurea coatings, Not for use in explosive atmospheres, GRACO, dated Jan. 2009, 72 pages.

Search Report and Written Opinion for International Application No. PCT/US2014/012441, date of mailing: May 8, 2014, date of filing: Jan. 22, 2014. 11pages.

* cited by examiner

PLURAL COMPONENT SYSTEM HEATER

CROSS-REFERENCE TO RELATED APPLICATION

The present application is based on and claims the benefit of U.S. provisional patent application Ser. No. 61/756,783, filed Jan. 25, 2013, the content of which is hereby incorporated by reference in its entirety.

BACKGROUND

Plural component systems provide a number of different liquid materials that are combined or mixed at a particular ratio to generate a composition that is delivered for coating a surface, for example. Some plural component applications include, but are not limited to, building construction and various applications within automotive, agricultural, marine, and industrial environments. More specifically, some particular applications include, but are not limited to, spraying foam insulation and spraying protective coatings on pipes and tanks, structural steel, and marine vessels, to name a few.

In many instances, plural component coatings can deliver benefits over single component coatings in particular applications, such as improved durability, better chemical resistance, increased flexibility, etc. Typically, when two or more components are combined in a plural component system a reaction is created between the components which can be both time and temperature dependent. Maintaining accurate temperatures of the plural components can be important.

The discussion above is merely provided for general background information and is not intended to be used as an aid in determining the scope of the claimed subject matter. The claimed subject matter is not limited to implementations that solve any or all disadvantages noted in the background.

SUMMARY

In one embodiment, a plural component heater assembly includes a plurality of heater modules each having a plurality of bores forming at least a first component path and a second component path, and at least one heating element receptacle configured to receive a heating element for heating the first and second component paths.

In one example, each of the heater modules comprises at least two bores forming a portion of the first component path and at least two bores forming a portion of the second component path.

In one example, the plurality of bores are substantially parallel.

In one example, bores of adjacent heater modules are fluidically coupled.

In one example, the plurality of heater modules comprises at least two heater modules in a stacked configuration. In one example, the stacked configuration is extensible by adding additional heater modules to the stack.

In one example, each heater module comprises a heating element receptacle that is centrally located between the plurality of bores formed in the heater module.

In one example, the assembly includes a heater assembly housing having a pair of opposed sidewalls configured to support the heater assembly.

In one embodiment, a plural component system includes a heater assembly comprising a first component heating path formed by at least three substantially parallel bores, a second component heating path formed by at least three substantially parallel bores, and at least one heating element receptacle configured to receive a heating element for heating the first and second component heating paths.

In one example, the first and second component heating paths are formed through a plurality of heater modules.

In one example, the system includes a first pump assembly configured to pump a first component from a source to the first component heating path, and a second pump assembly configured to pump a second component from a source to the second component heating path. In one example, at least one controller is configured to control a speed of the first and second pump assemblies.

In one example, the system includes a first motor configured to operate the first pump assembly and a second motor configured to operate the second pump assembly. The controller is configured to control a speed of the second motor relate to a speed of the first motor.

In one example, the system includes a spray gun configured to receive the first and second components heated by the heater assembly.

In one example, each heater module comprises a heating element receptacle.

In one embodiment, a method of forming a heater module having first and second bores separated by a material includes inserting a cutting tool into an end of the first bore and creating a passageway between the first and second bores by moving the cutting tool toward the second bore to remove at least a portion of the material.

In one example, the first and second bores are substantially parallel.

In one example, moving the cutting tool toward the second bore removes a first portion of the material, and creating the passageway further comprises inserting the cutting tool into an end of the second bore and moving the cutting tool toward the first bore to remove a second portion of the material.

In one example, the heater module comprises a block formed by an extrusion process. In one example, the cutting tool comprises a woodruff or key cutter.

This summary is provided to introduce a selection of concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

Figure 1:
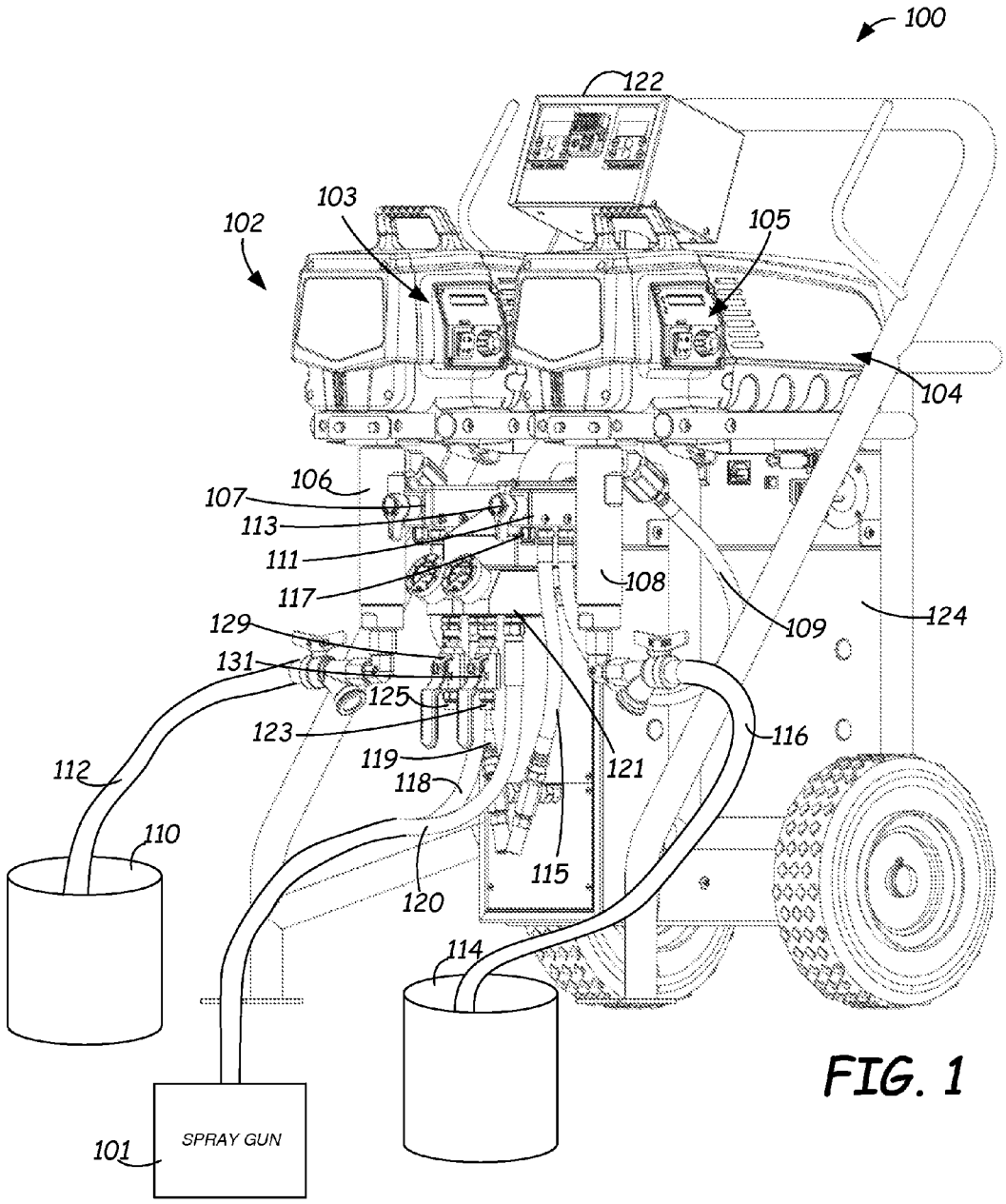
FIG. 1 is a perspective view of a plural component system, under one embodiment.

FIG. 1 illustrates one embodiment of a plural component system 100 that is configured to deliver two or more liquid components that are combined, for instance using an output component or applicator such as, but not limited to, a spray gun or extruding gun. In one example, a spray gun (schematically represented in FIG. 1 by block 101) combines (e.g., externally or internally in an internal mixing chamber) the liquid components which are sprayed onto a surface.

In the illustrated embodiment, system 100 includes a first pump unit 102 and a second pump unit 104 each configured to pump a respective component. Pump unit 102 includes a first piston pump assembly 106 and pump unit 104 includes a second piston pump assembly 108. Piston pump assembly 106 receives a component from a first container 110 via a tube or hose 112 and piston pump assembly 108 receives a component from a second container 114 via a tube or hose 116. Examples of containers 110 and 114 include, but are not limited to, fifty-five gallon barrels. The pressurized components are delivered to a spray gun (not shown in FIG. 1) or other output device via hoses 118 and 120. It is noted that while two pump units are illustrated, in one embodiment three or more pump units can be utilized each configured to deliver a respective component at a desired ratio.

System 100 includes one or more controllers. In the illustrated embodiment, system 100 includes a heater controller 122 configured to controller operation of a heater assembly. Further, each pump unit 102 and 104 includes a controller 103 and 105 configured to control the respective pump unit to deliver the components at a desired ratio and/or pressure. For example, the components can be sprayed at pressures up to or exceeding 3,200 pounds per square inch (PSI) and in ratios of 1:1, 1.25:1, 1.5:1, 1.75:1, 2:1, 5:1 or any other desired ratio. In one embodiment, a single controller can be provide for controlling operation of the pump units and heater assembly.

The pressurized fluid from each piston pump assembly 106 and 108 is provided through a tube to a prime/spray valve. As illustrated in FIG. 1, a tube 109 provides a path from second piston pump assembly 108 to a prime/spray valve 111 having a knob 113 to select between priming and spraying functions. In the spraying position, the fluid is directed through a tube 115 into housing 124. In a priming position, the fluid is directed from a port 117 through a return hose (not shown in FIG. 1) to container 114. Similar tubes and components are provided for assembly 106.

Housing 124 comprises an enclosure housing a heater assembly that receives the first and second liquid components via tubes 115 and 119, respectively. Tube 119 provides a path from prime/spray valve 107 associated with first piston pump assembly 106.

Heated liquid components exit housing 124 into a secondary housing 121. Housing 121 provides a sealed gateway for the electrical heating wires of heating elements 133 and 135, discussed in further detail below. Housing 121 also provides an attachment of pressure gauges and recirculating valve assemblies 129 and 131 for each component. Recirculating valve assembles 129 and 131 are operable to selectively direct the liquid components to return paths to the containers. Illustratively, assembly 131 is operable to supply the first component to either hose 120 or through a recirculating hose attached to port 123. Assembly 129 is operable to supply the second component to either hose 118 or through a recirculating hose attached to port 125. In this manner, the recirculating valve assemblies 129 and 131 allow the components to be circulated through the heater assembly for preheating prior to spraying.

Figure 2:
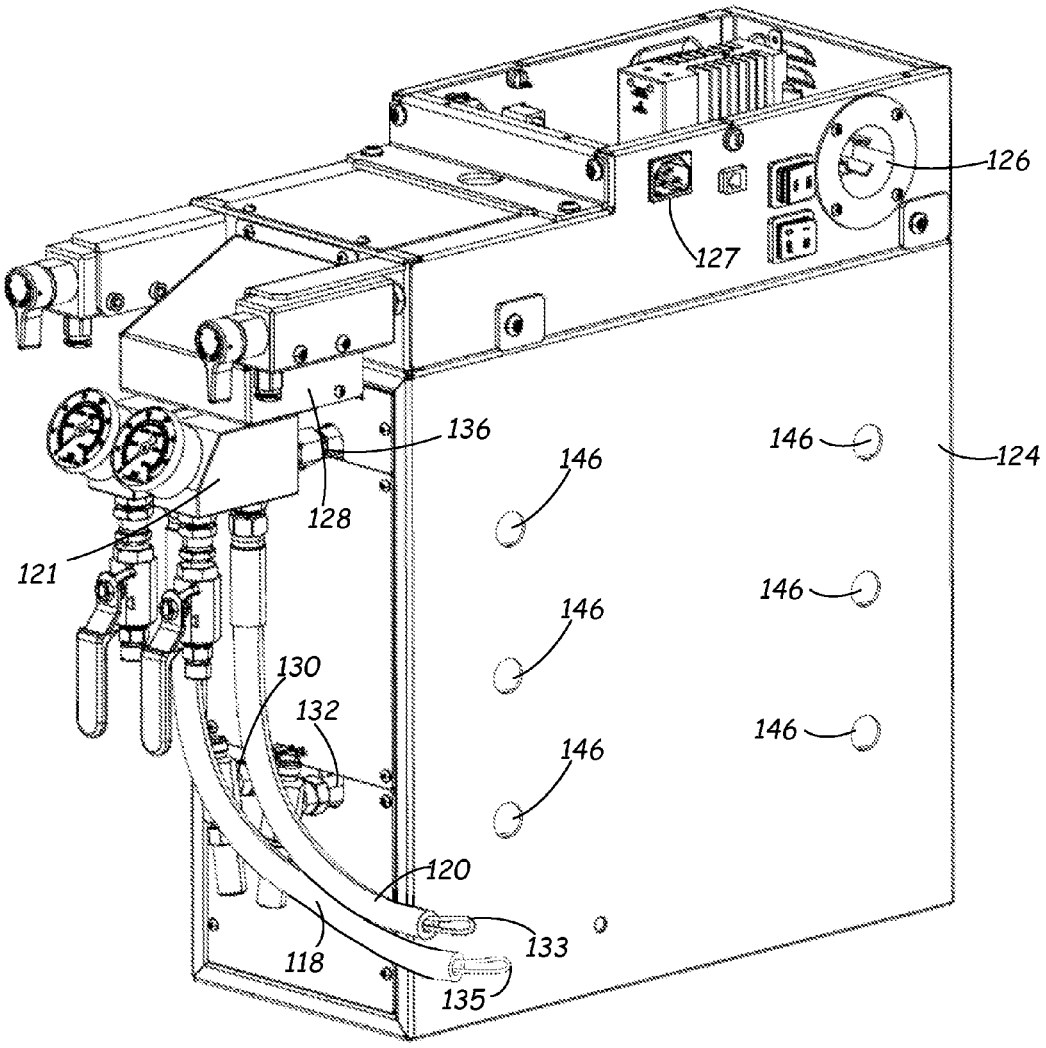
FIG. 2 is a perspective view of a housing for a heater assembly, under one embodiment.
Figure 3:
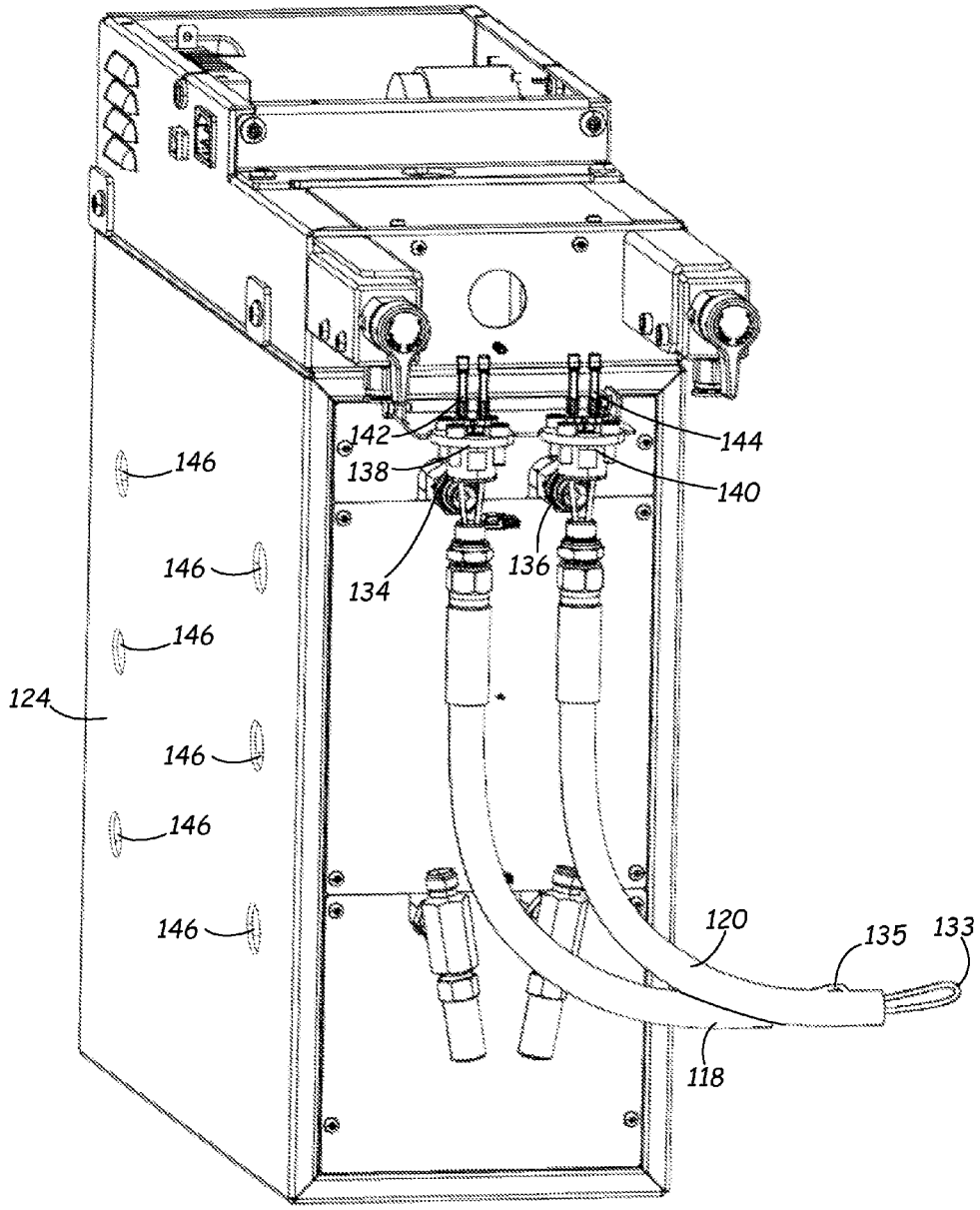
FIG. 3 is a perspective view of the housing shown in FIG. 2 with a cover omitted.

FIGS. 2 and 3 are perspective views illustrating housing 124 in further detail. FIG. 3 omits a cover 128 and housing 121 for illustration purposes.

Housing 124 includes an electrical connection 126 to provide power to the heater assembly, pump units, and/or controller(s). In one embodiment, a second electrical connection 127 can also be provided for providing a separate power source for the pump units and/or controller(s).

Inlet connections 130 and 132 are provided for receiving the pressurized components from tubes 117 and 119 (shown in FIG. 1) and provide paths for the first and second components into the heater assembly. Outlet connections 134 and 136 provide the heated components to housing 121.

In the illustrated embodiment, secondary heaters 138 and 140 are provided having heating elements disposed within hoses 118 and 120 for further heating of the components. Electrical connectors 142 and 144 provide power to heating elements 133 and 135. In one embodiment, the heating elements 133 and 135 are controlled by heater controller 122.

In one embodiment, housing 124 includes a plurality of apertures 146 that enable fasteners to be inserted for securing the heater assembly within housing 124.

Figure 4:
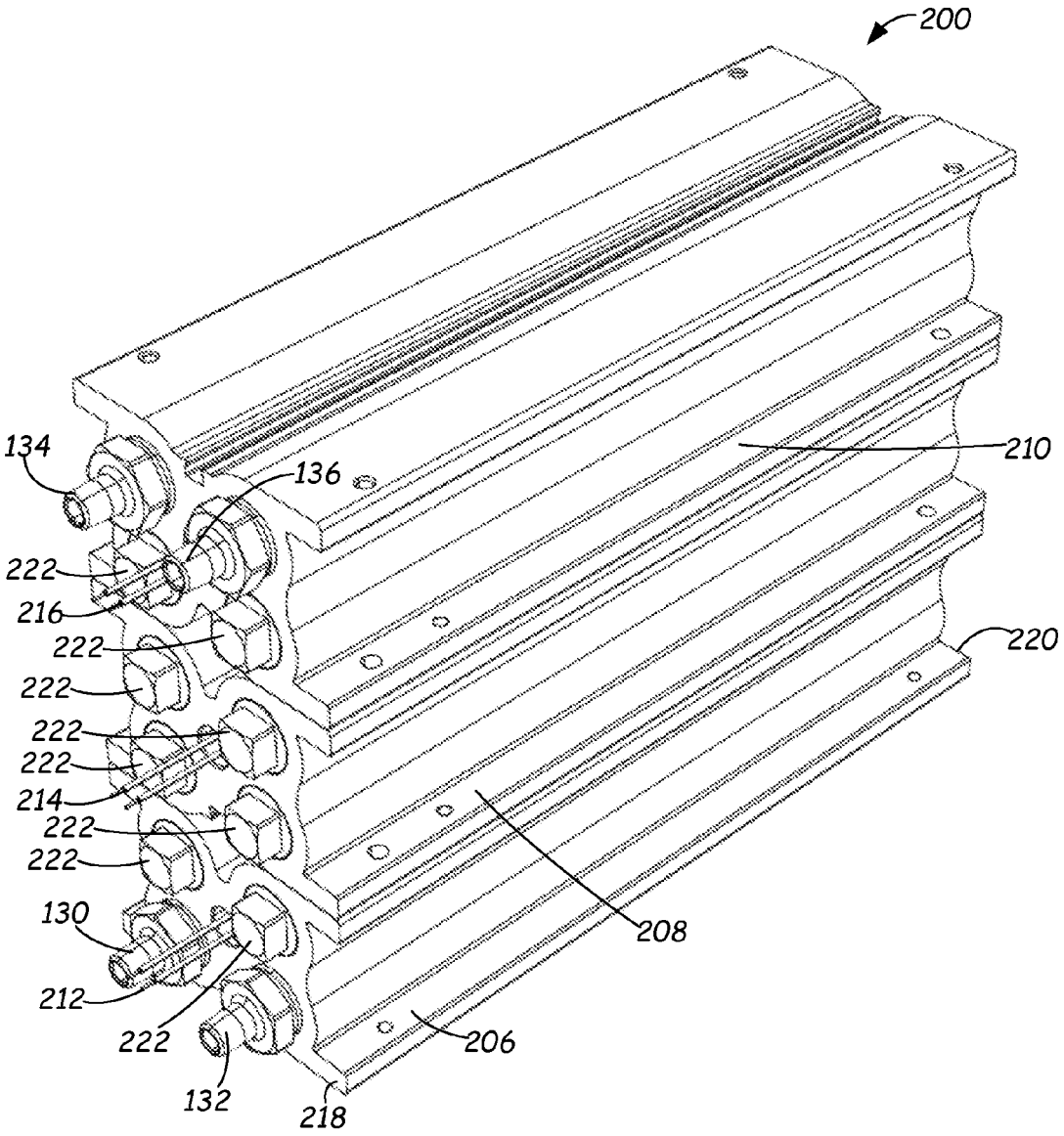
FIG. 4 is a perspective view of a heater assembly, under one embodiment.

FIG. 4 is a perspective view of one embodiment of a heater assembly 200. Heater assembly 200 has a separate heating path for each component. Illustratively, a first path for a first one of the components is formed between connectors 130 and 134 and a second path for a second one of the components is formed between connectors 132 and 136. While two component heating paths are illustrated, in another example one or more additional paths can be provided for heating additional (e.g., more than two) components.

Each heating path is formed by a plurality of bores. Illustratively, more than two bores for each path are oriented in parallel to each other. The liquid components are heated as they flow through each of the parallel bores. While the bores are illustrated herein as being substantially cylindrical, it is noted that in other embodiments one or more of the bores can have non-cylindrical shapes.

In the illustrated embodiment, heater assembly 200 illustratively comprises a plurality of stacked heater modules each having a plurality of bores. The bores of each module form a portion of the heating paths between inlet connectors 130 and 132 and outlet connectors 134 and 136.

The configuration of heater assembly 200 is extensible and enables the number of heater modules to be selected based on heating requirements for the plural component system. In this manner, for example, a manufacturer or an end user can add additional heater modules to increase the overall length of the heating paths and thus the amount of heat added to the components, without significantly increasing the overall size of the heater assembly or requiring the length of the individual modules to be increased. Further, the stacked configuration can reduce the heating requirements of the heating elements. That is, for a given flow rate, as the length of the flow paths increases the amount of time the components remain in the heater assembly increases and the required temperature of the heating elements decreases.

Exemplary heater assembly 200 illustratively includes a first heater module 206, a second heater module 208, and a third heater module 210. While three heater modules 206, 208, and 210 are illustrated, in other examples less than or more than three heater modules are utilized.

Each heater module 206, 208, and 210 includes a respective heating element receptacle configured to receive a heating element to heat the module. In the illustrated example, each heater module includes a cartridge heater disposed within a centrally located receptacle. Each cartridge heater has electrical leads 212, 214, and 216 supplying electrical power to the cartridge heater. The cartridge heaters heat the modules 206, 208, and 210 which transfer the heat to the plural components flowing through assembly 200. The heating elements are illustratively controlled by heater controller 122 (shown in FIG. 1).

Heater modules 206, 208, and 210 can comprise blocks formed of any suitable material. In one embodiment, the blocks are formed of metal, such as but not limited to, aluminum, using an extrusion process.

The heater modules 206, 208, and 210 have a first end 218, a second end 220, and a plurality of bores formed between ends 218 and 220.

A plurality of plugs 222 are positioned at ends of selected ones of the bores depending on the desired configuration of the heater assembly 200. In one example, the plugs 222 are threadably engaged to ends of the bores. In other examples, the plugs 222 are fixedly positioned to ends of the bores, such as by welding or otherwise securing the plugs to the heater module blocks.

In one embodiment, a heater module has a length between ends 218 and 220 of less than 24 inches. In one embodiment, the length is less than 18 inches. In one particular example, the length is approximately 16.5 inches.

Figure 5:
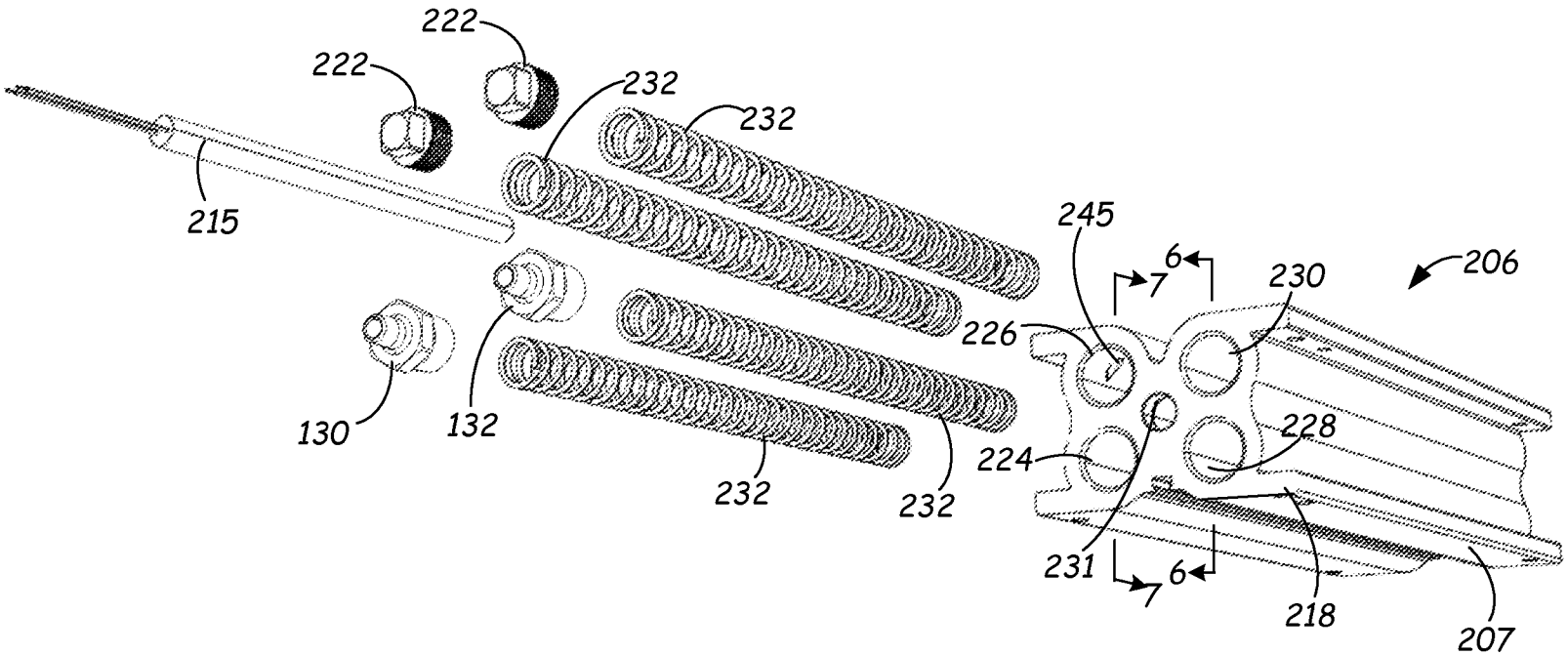
FIG. 5 is a partially exploded perspective view of a heater module, under one embodiment.
Figure 6:
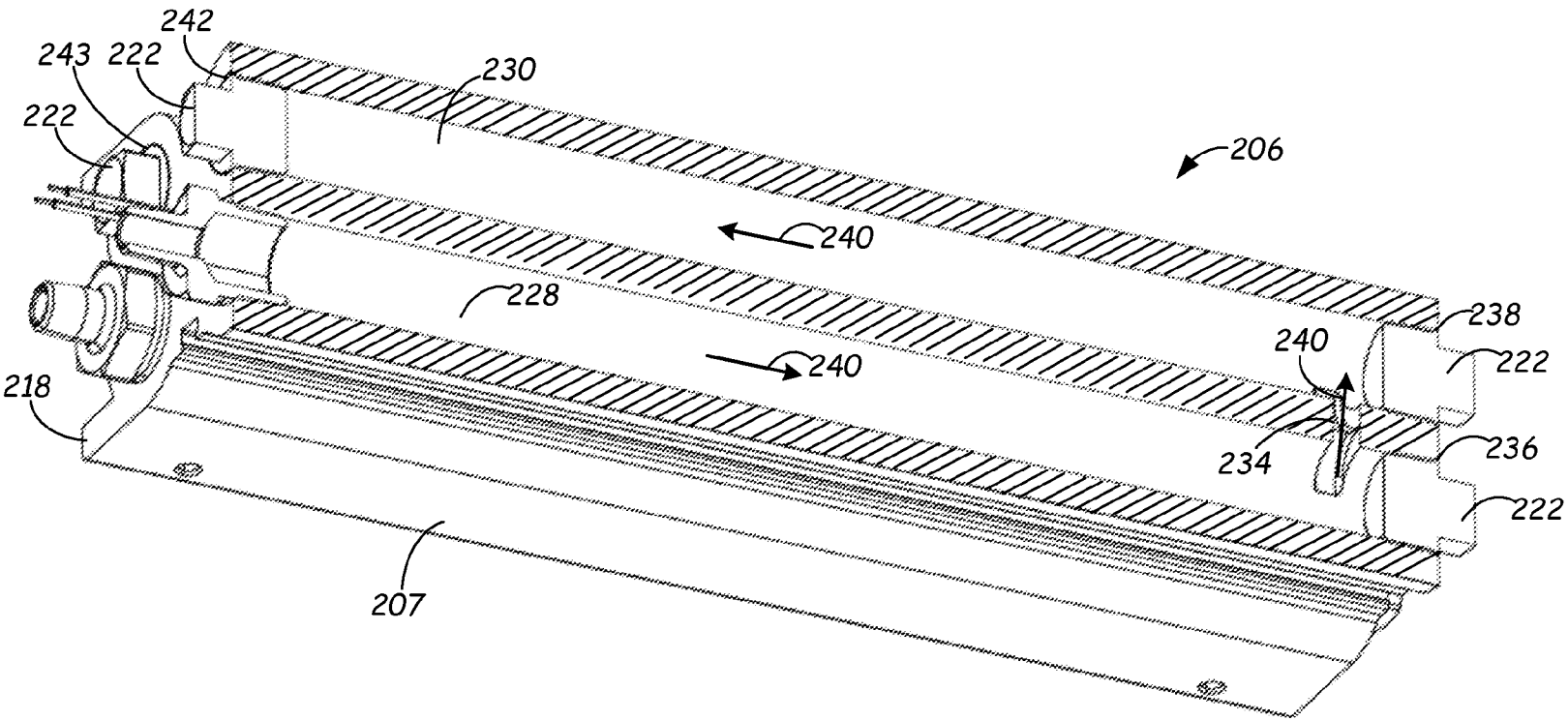
FIG. 6 is a perspective sectional view of the heater module shown in FIG. 4 taken at line 6-6.

FIG. 5 is a partially exploded perspective view of heater module 206. FIG. 6 is a perspective sectional view of module 206 taken at line 6-6 (shown in FIG. 5) and FIG. 7 is a side sectional view of module 206 taken at line from end 218 with a cross-section taken at line 7-7 (shown in FIG. 5).

Figure 7:
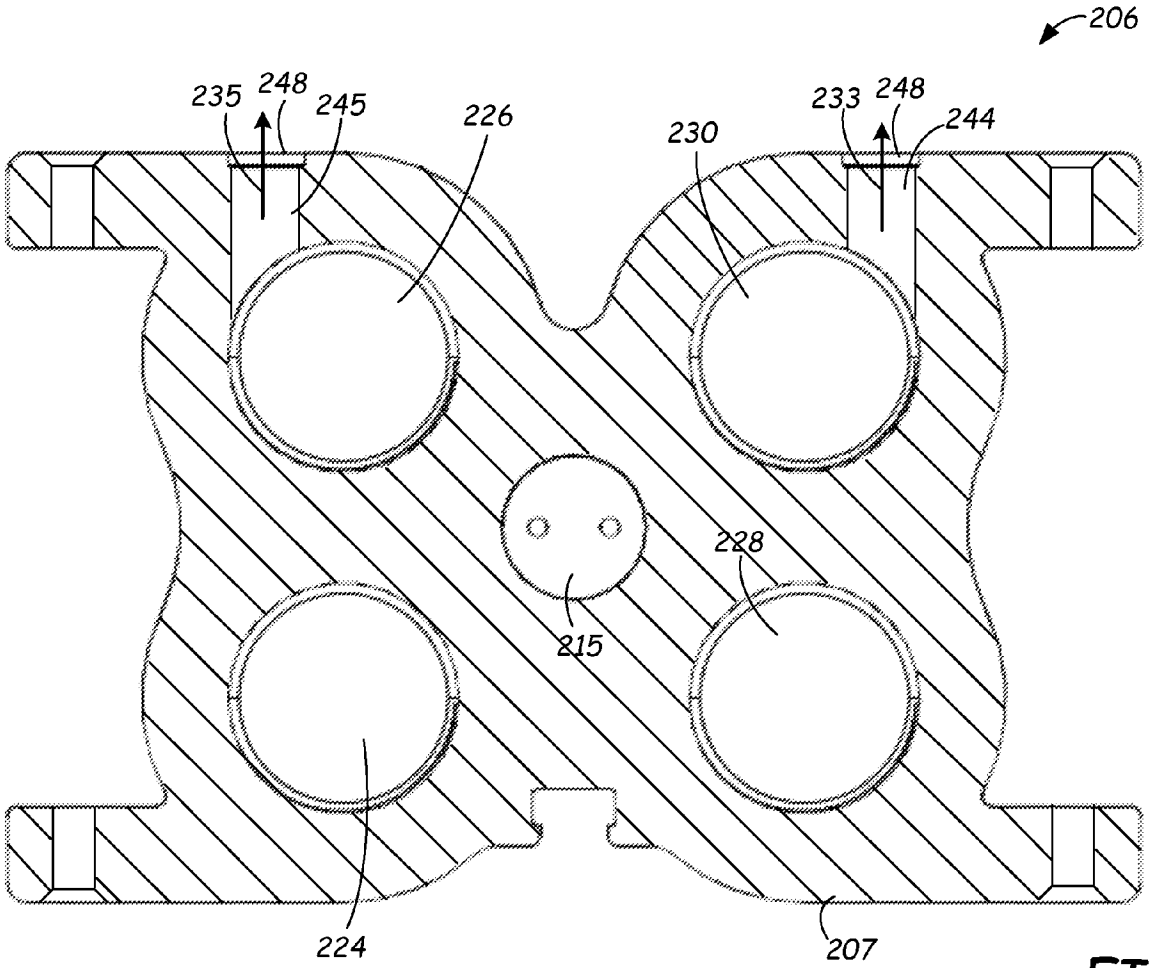
FIG. 7 is a side sectional view of the heater module shown in FIG. 5 taken at line 7-7.

As illustrated in FIGS. 5-7, module 206 has a plurality of bores 224, 226, 228, and 230 formed in a heater block 207. In one embodiment, bores 224, 226, 228, and 230 are substantially parallel to one another. A centrally located receptacle 231 is configured to receive a heating element 215 for module 206. Bore 224 receives connector 130 and is fluidically coupled to bore 226. Bore 228 receives connector 132 and is fluidically coupled to bore 230.

In the illustrated embodiment, a static mixing element 232 is provided within each bore 224, 226, 228, and 230 to encourage even distribution of heat in the component flow. The static mixing elements 232 have been omitted from FIGS. 6 and 7 for illustration purposes.

Bores 228 and 230 are connected by an opening 234 that forms a transverse passageway therebetween. The plugs 222 positioned at bore ends 236 and 238 cause component flow as generally illustrated by arrows 240. In the illustrated embodiment, bores 224 and 226 include an opening similar to opening 234 and are a mirror image of bores 228 and 230.

The plugs 222 positioned at end 242 of bore 230 and end 243 of bore 226 cause the respective components to flow in a direction generally illustrated by arrows 233 and 235 into the adjacent heater module (i.e., module 208). As shown in FIG. 7, a port 244 to an adjacent bore is provided from bore 230 and a port 245 (also shown in FIG. 5) to an adjacent bore is provided from bore 226. In the illustrated embodiment, a recess 248 is provided at each port 244 and 245 for receiving an o-ring or other mechanism for sealing the interface between module 206 and module 208.

Figure 8:
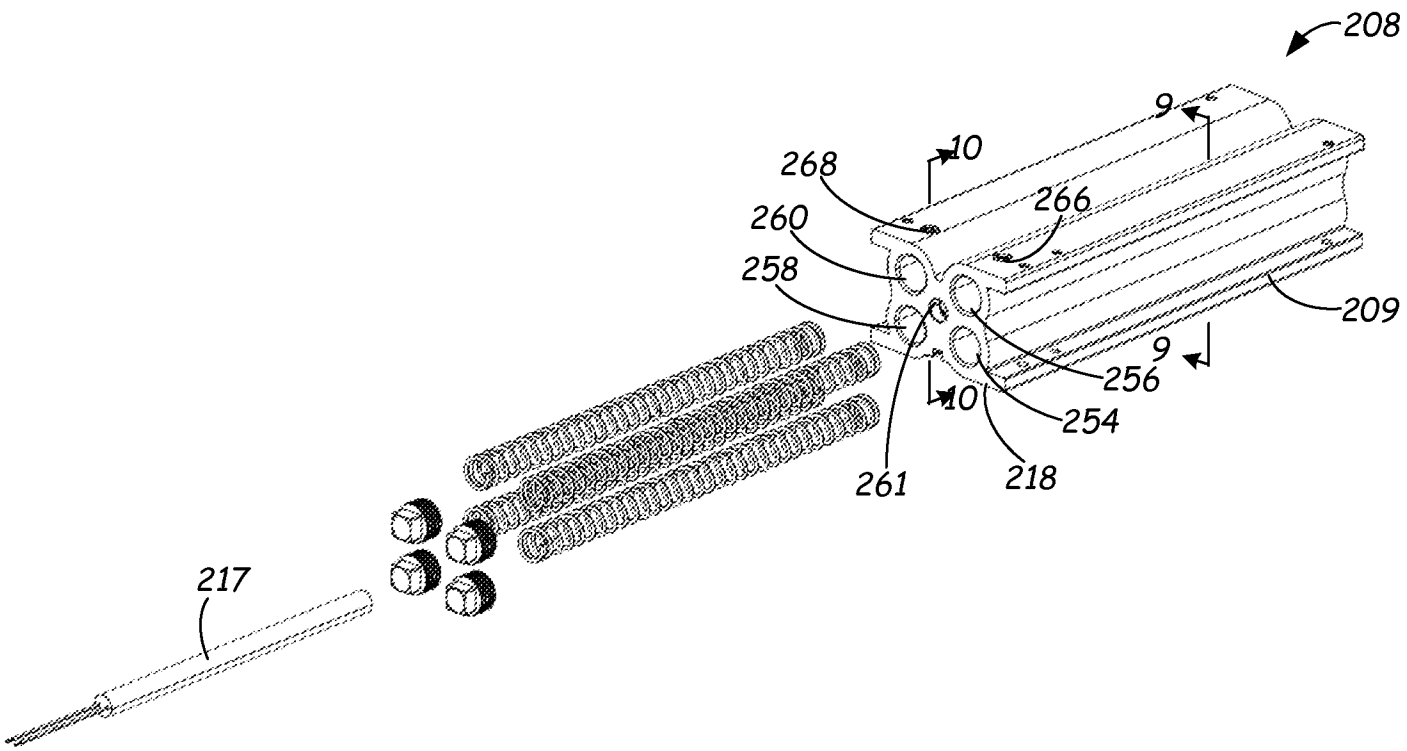
FIG. 8 is a partially exploded perspective view of a heater module, under one embodiment.
Figure 9:
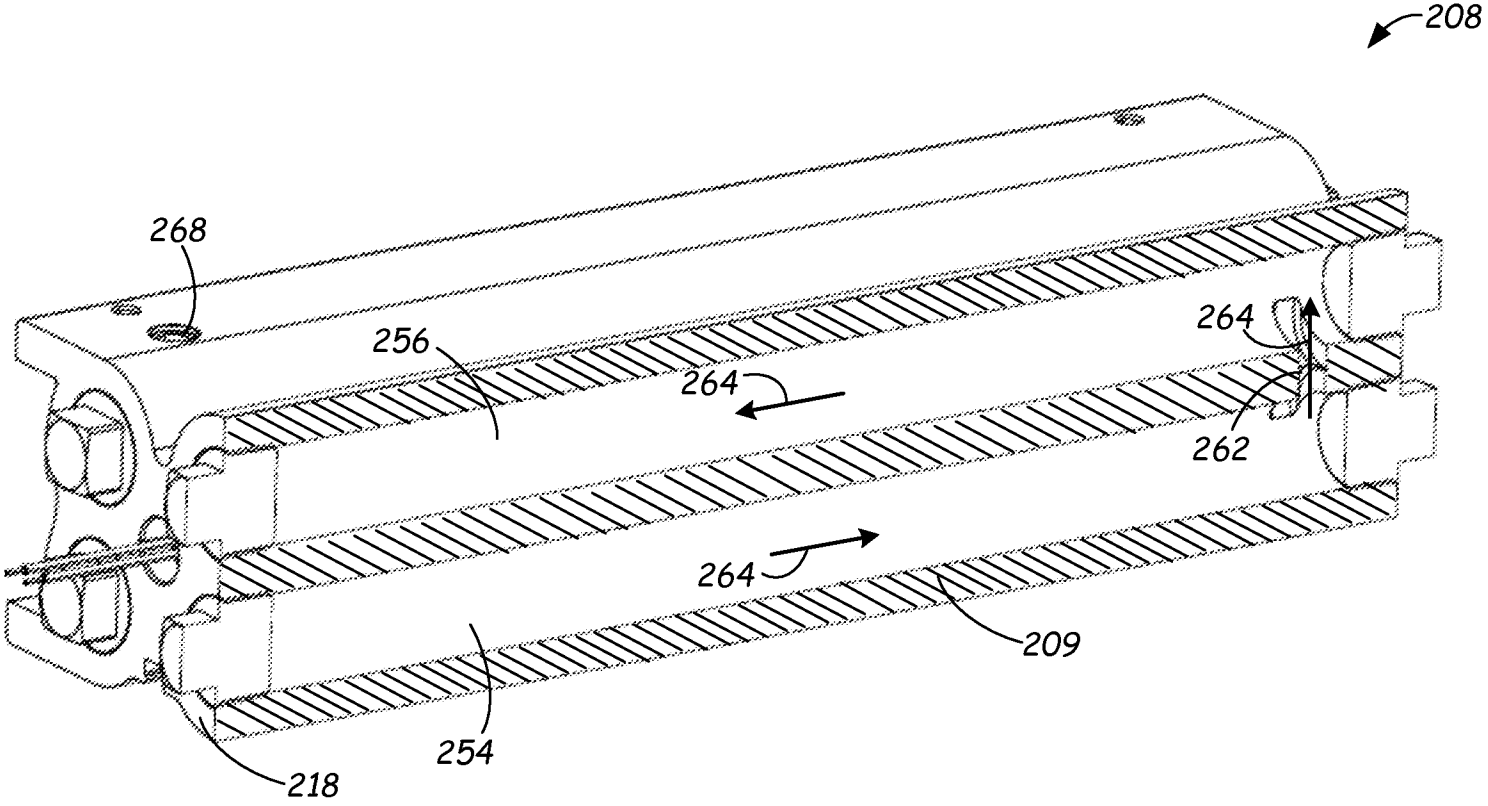
FIG. 9 is a perspective sectional view of the heater module shown in FIG. 8 taken at line 9-9.
Figure 10:
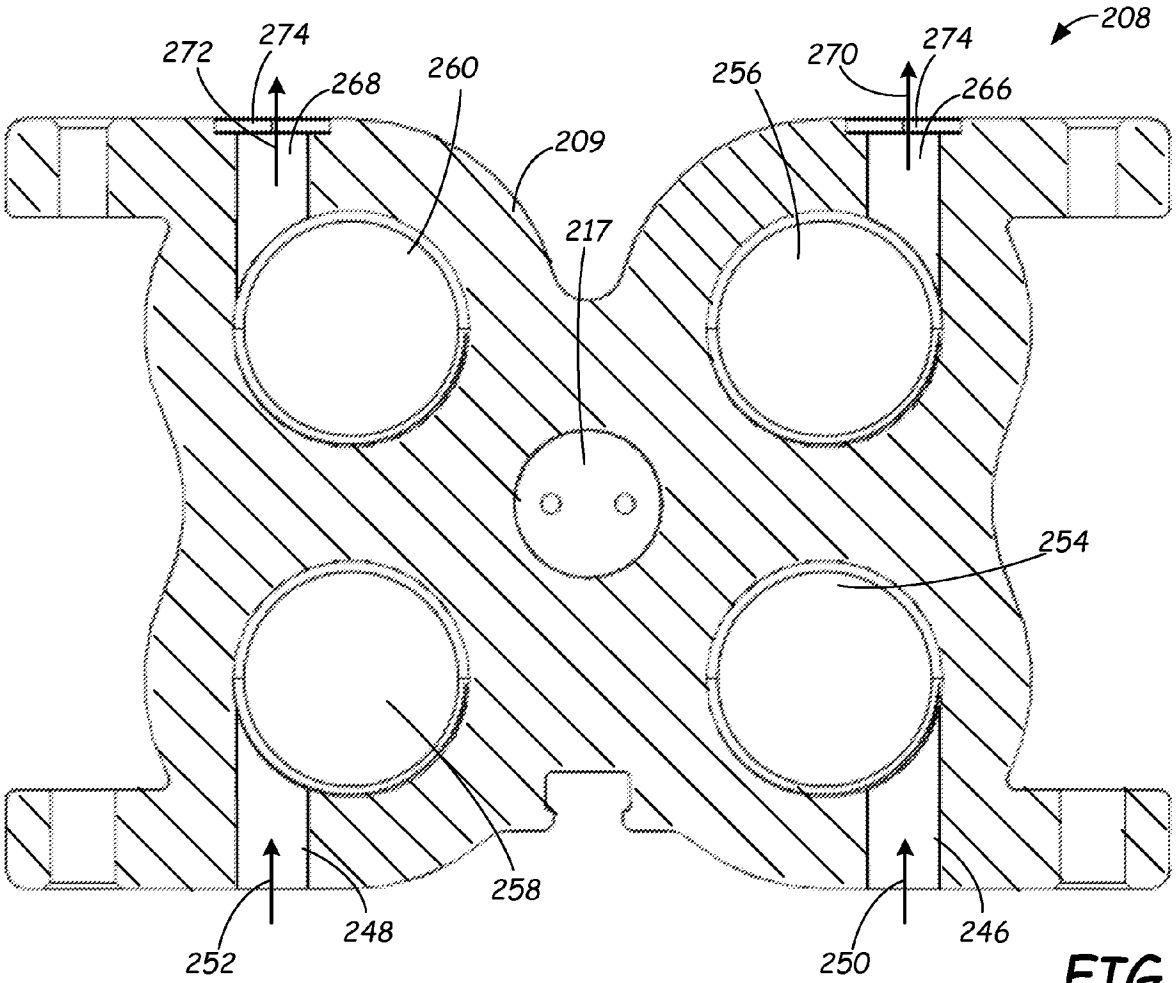
FIG. 10 is a side sectional view of the heater module shown in FIG. 8 taken at line 10-10.

Heater module 208 is illustrated in FIGS. 8, 9, and 10. FIG. 8 is a partially exploded perspective view, FIG. 9 is a perspective sectional view taken at line 9-9 (shown in FIG. 8) and FIG. 10 is a side sectional view taken at line 10-10 (shown in FIG. 8).

As illustrated in FIGS. 8-10, module 208 has a plurality of bores 254, 256, 258, and 260 formed in a heater block 209. In one embodiment, bores 254, 256, 258, and 260 are substantially parallel to one another. A centrally located bore 261 is configured to receive a heating element 217 for module 208.

A port 246 is aligned with port 244 of module 206 and a port 248 is aligned with port 245 of module 206. The respective component flows enter bores 254 and 258 as generally represented by arrows 250 and 252. Bore 254 is fluidically coupled to bore 256 and bore 258 is fluidically coupled to bore 260.

Bores 254 and 256 are connected by an opening 262 that forms a transverse passageway therebetween. The component flow is generally illustrated by arrows 264. In the illustrated embodiment, bores 258 and 260 include an opening similar to opening 262 and are a mirror image of bores 254 and 256.

The respective components flow (generally illustrated by arrows 270 and 272) from bores 256 and 260 into the adjacent heater module (i.e., module 210). As shown in FIG. 10, a port 266 to an adjacent bore is provided from bore 256 and a port 268 (also shown in FIGS. 8 and 9) to an adjacent bore is provided from bore 260. In the illustrated embodiment, a recess 274 is provided at each port 266 and 268 for receiving an o-ring or other mechanism for sealing the interface between module 208 and module 210.

In one embodiment, heater modules 206 and 210 at the top and bottom of the stack are substantially identical and oriented one-hundred eighty degrees with respect to each other. In one embodiment, the block of heater module 208 is similar to the blocks of heater modules 206 and 210, and includes the additional ports 266 and 268. To further expand the heating capabilities of heater assembly 200, additional heater modules similar to module 208 can be added in the stacked configuration between modules 206 and 210.

Additionally, it is noted that in one embodiment one heater block can be utilized having more than two bores for each component flow path. For example, a single piece of extruded aluminum can have bores similar to bores 224, 226, 228, 230, 254, 256, 258, 260, 276, 278, 280, and 288.

Figure 11:
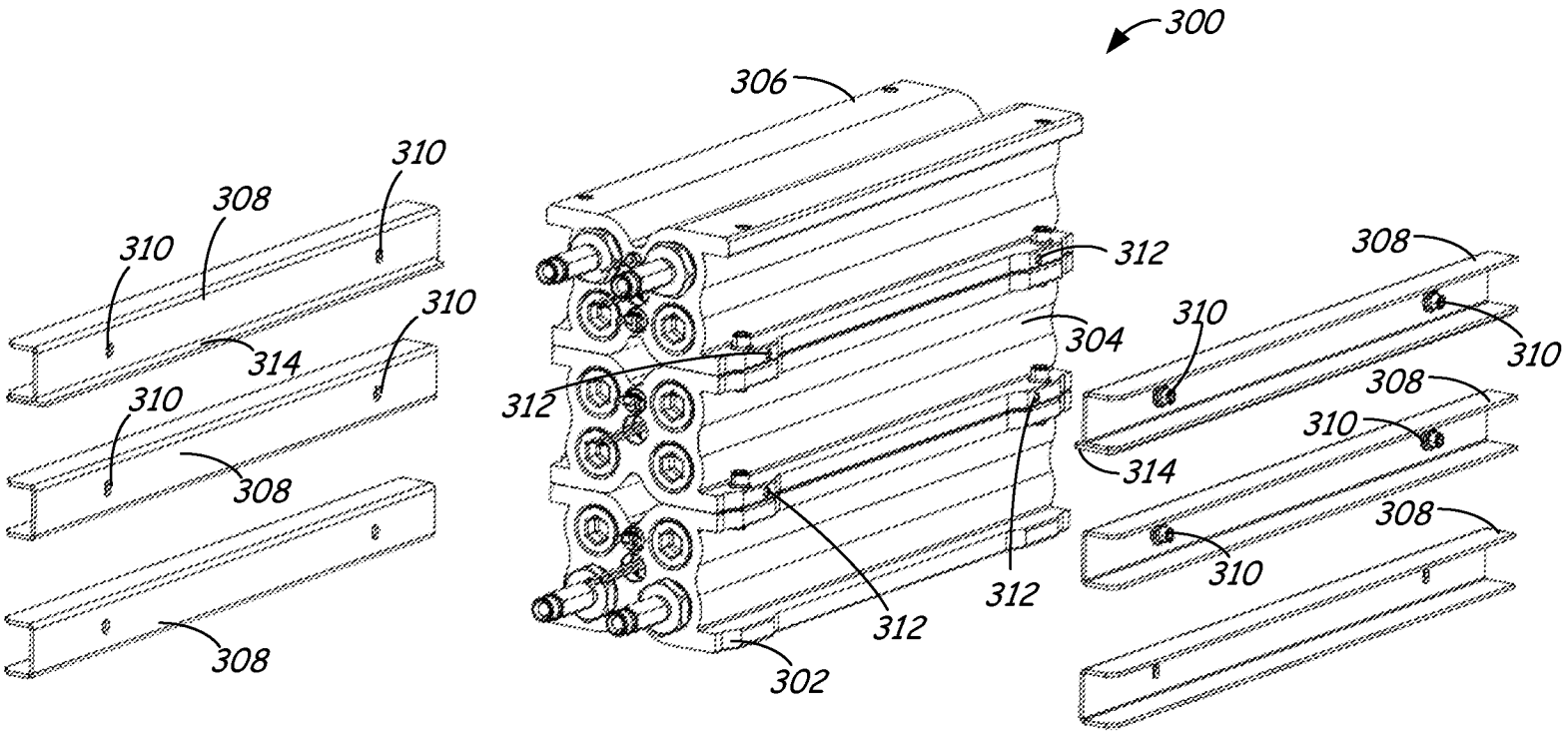
FIG. 11 is a front perspective view of a heater assembly, under one embodiment.

FIG. 11 is a perspective view of one embodiment of a heater assembly 300 having a plurality of heater modules 302, 304, and 306. FIG. 11 also illustrates a plurality of mounting brackets 308 configured to support assembly 300 within a housing. For example, brackets 308 can be secured within housing 124 illustrated in FIG. 1. In one example, brackets 308 include apertures 310 that are aligned with the apertures 146 formed through housing 124. This allows a user to insert fasteners through apertures 310 and into corresponding threaded holes 312 on assembly 300. In the illustrated embodiment, brackets 308 can also include rails 314 configured to facilitate sliding assembly 300 into housing 124.

Figure 12:
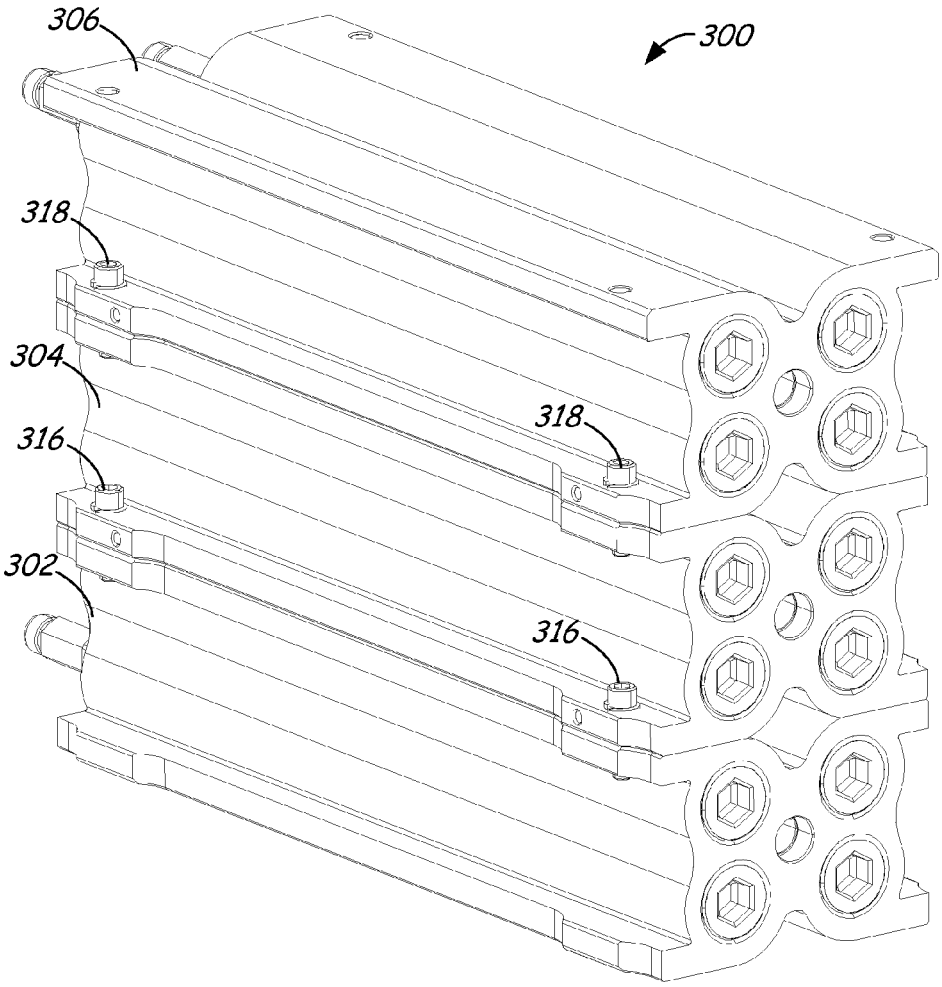
FIG. 12 is a rear perspective view of the heater assembly shown in FIG. 11.

FIG. 12 is a rear perspective view of assembly 300. As illustrated, modules 302 and 304 are secured together using fasteners 316 and modules 304 and 306 are secured together using fasteners 318.

Figure 14:
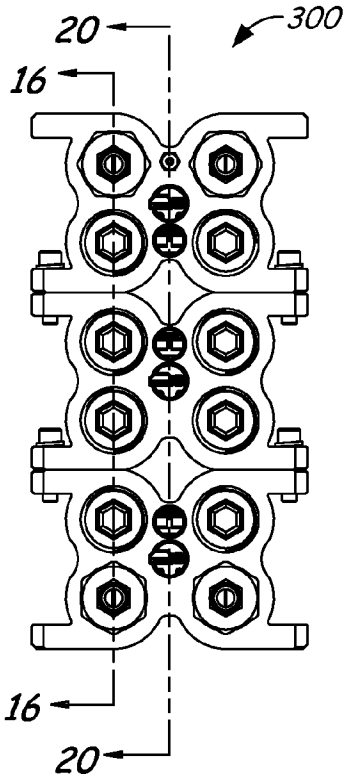
FIGS. 13 and 14 are side elevation views of the heater assembly of FIG. 11.
Figure 13:
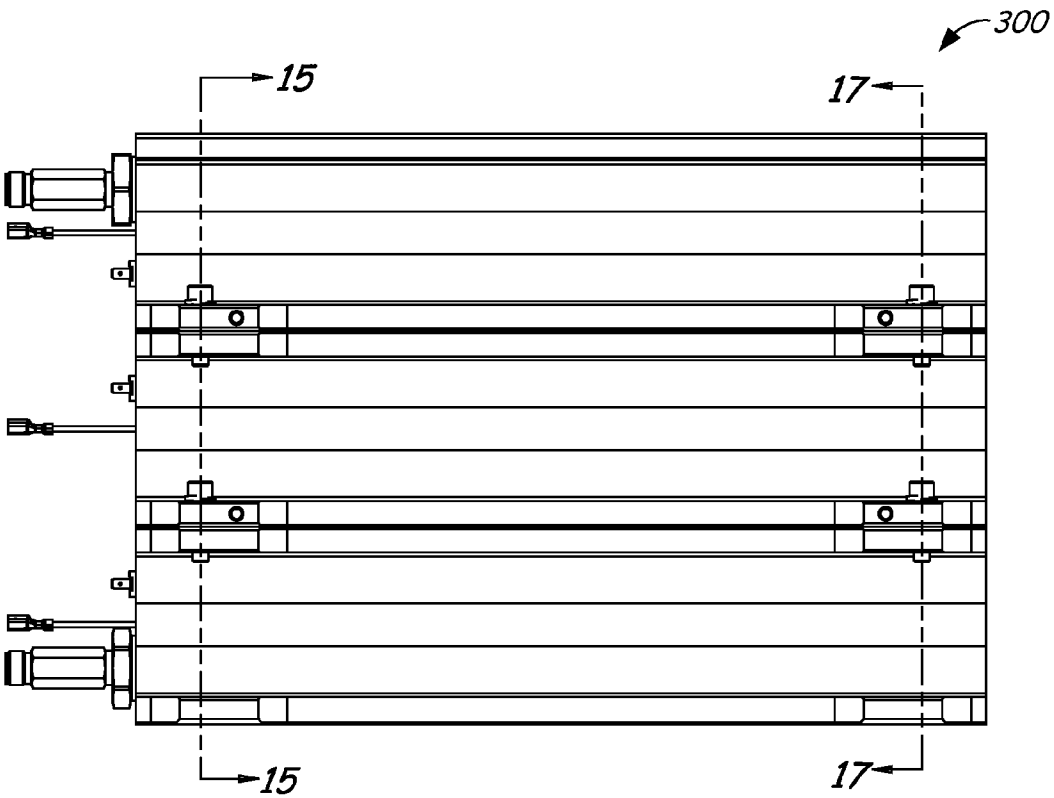
Figure 15:
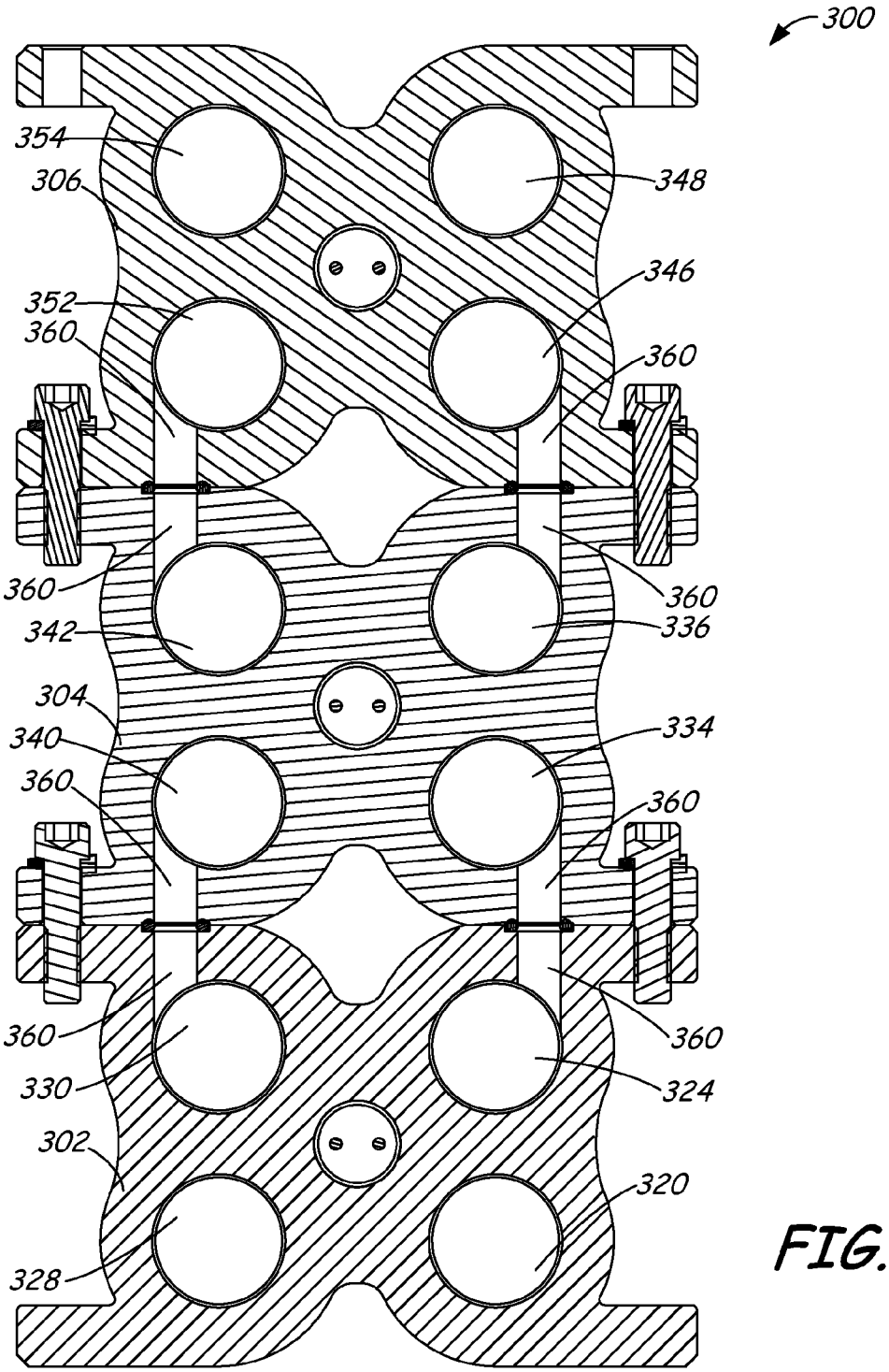
FIG. 15 is a side sectional view of the heater assembly of FIG. 11 taken at line 15-15 shown in FIG. 13.
Figure 16:
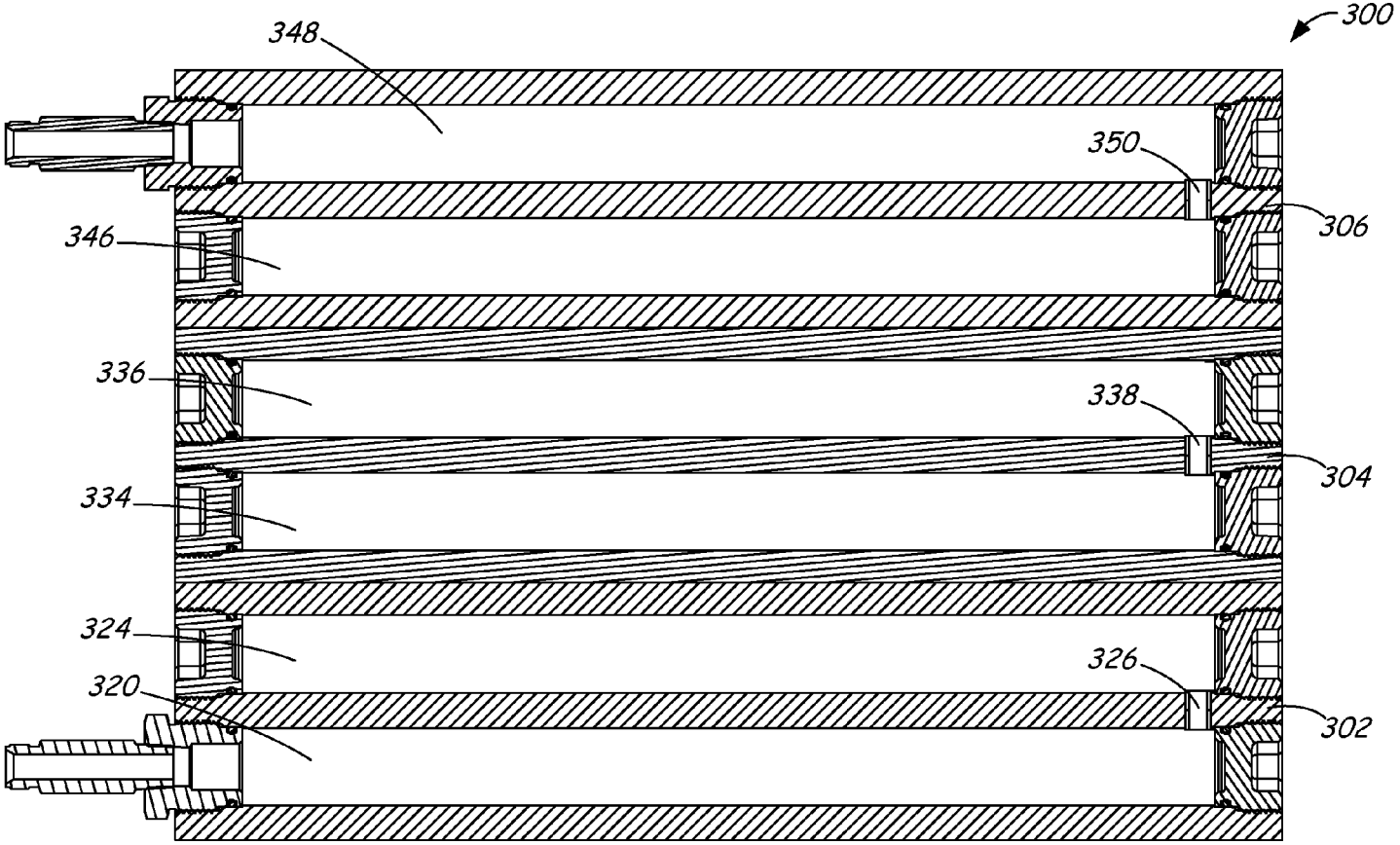
FIG. 16 is a side sectional view of the heater assembly of FIG. 11 taken at line 16-16 shown in FIG. 14.
Figure 17:
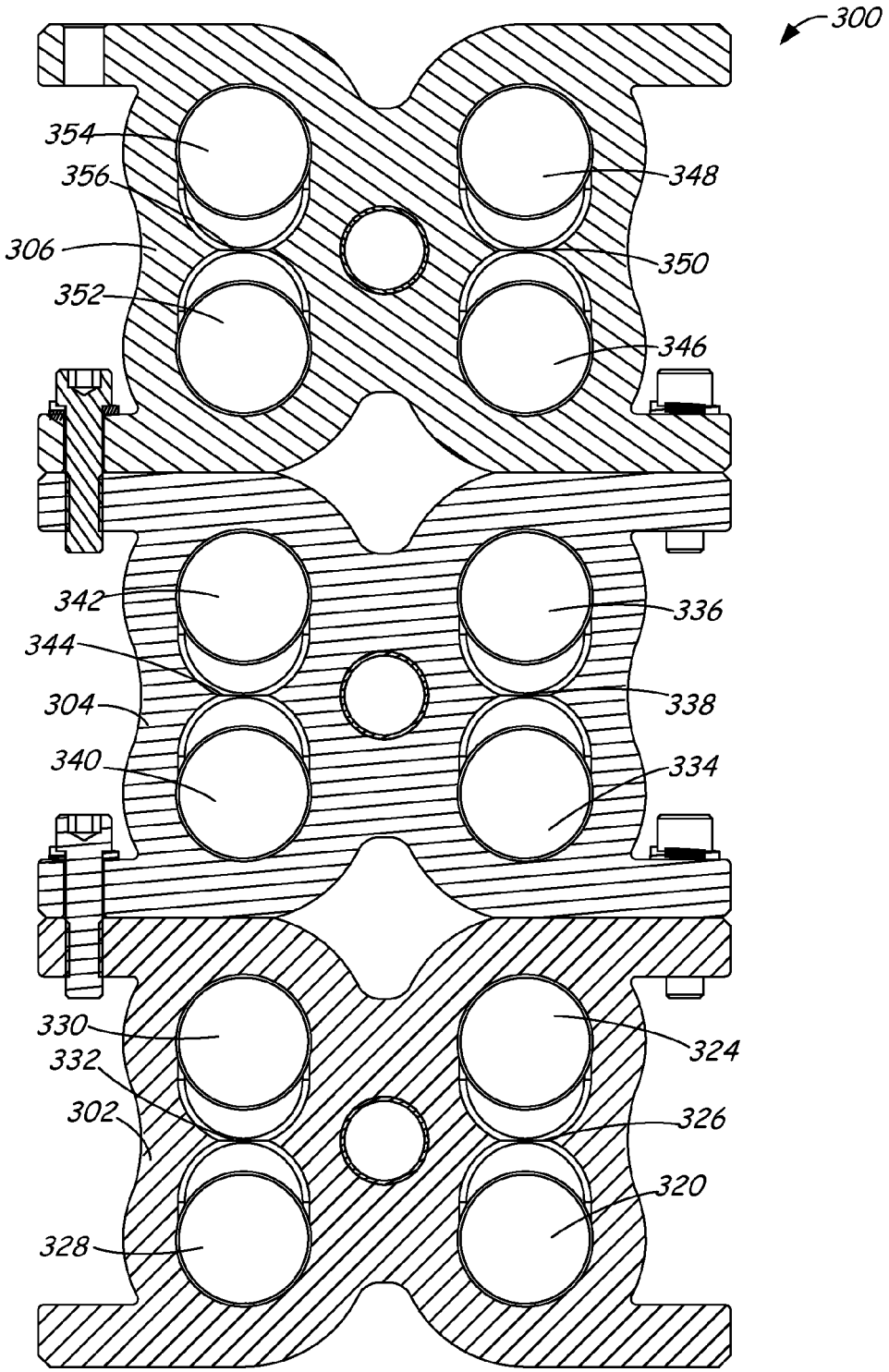
FIG. 17 is a side sectional view of the heater assembly of FIG. 11 taken at line 17-17 shown in FIG. 13.

FIGS. 13 and 14 are side elevation views of heater assembly 300. FIG. 15 is a side sectional view of heater assembly 300 taken at line 15-15 shown in FIG. 13. FIG. 16 is a side sectional view of heater assembly 300 taken at line 16-16 shown in FIG. 14. FIG. 17 is a side sectional view of heater assembly 300 taken at line 17-17 shown in FIG. 13.

As illustrated in FIGS. 15-17, heater module 302 includes a first bore 320 coupled to a second bore 324 by a transverse passageway 326. A third bore 328 is coupled to a fourth bore 330 by a transverse passageway 332.

Module 304 has a first bore 334 coupled to a second bore 336 by a transverse passageway 338. A third bore 340 is coupled to a fourth bore 342 by a transverse passageway 344.

Module 306 includes a first bore 346 coupled to a second bore 348 by a transverse passageway 350. A third bore 352 is coupled to a fourth bore 354 by a transverse passageway 356.

Figure 18:
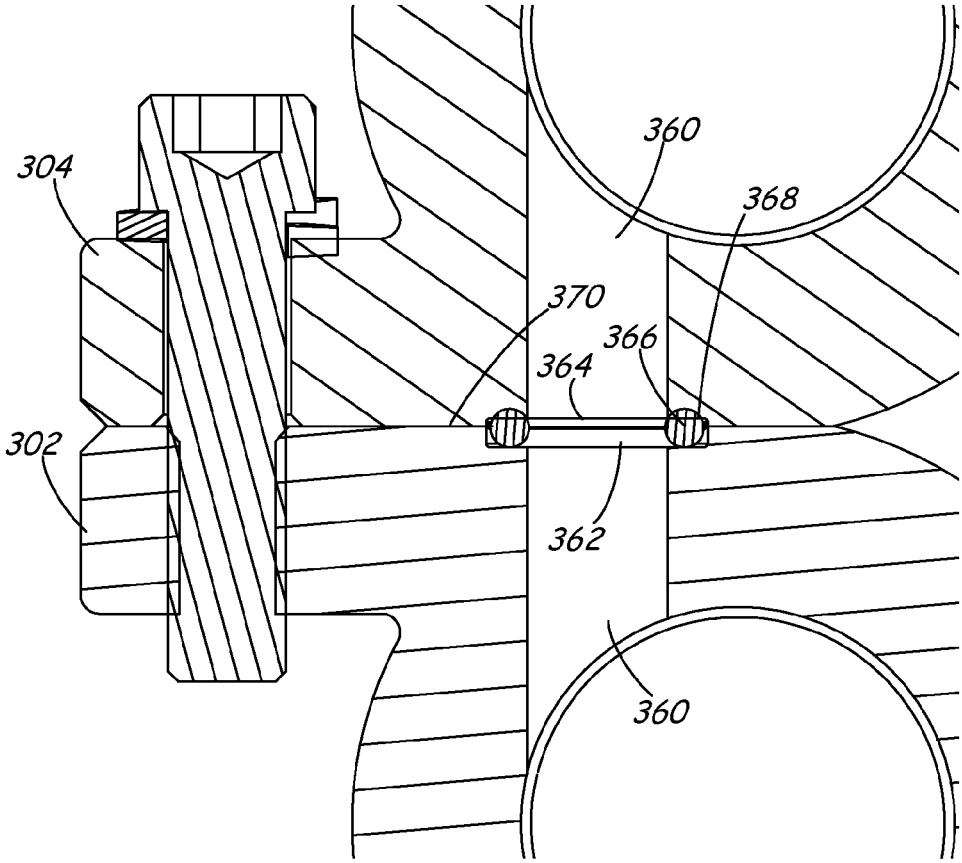
FIG. 18 is an enlarged view of a portion of FIG. 15.

Bores of adjacent modules are connected together by ports 360. FIG. 18 is an enlarged view of FIG. 15 illustrating one example of an interface between adjacent modules 302 and 304. Module 302 has a recess 362 that is aligned with a recess 364 of module 304. Recesses 362 and 364 accommodate an o-ring 366 at the interface between modules 302 and 304. In the illustrated embodiment, recess 362 has a greater depth than recess 364 and retains o-ring 366 during assembly and disassembly of the modules. Recess 364 offsets the surface 368 of recess 364 away from the bottom surface 370 of module 304 to reduce a likelihood of damage to surface 368 which may affect the interface seal made by o-ring 366.

Figure 19:
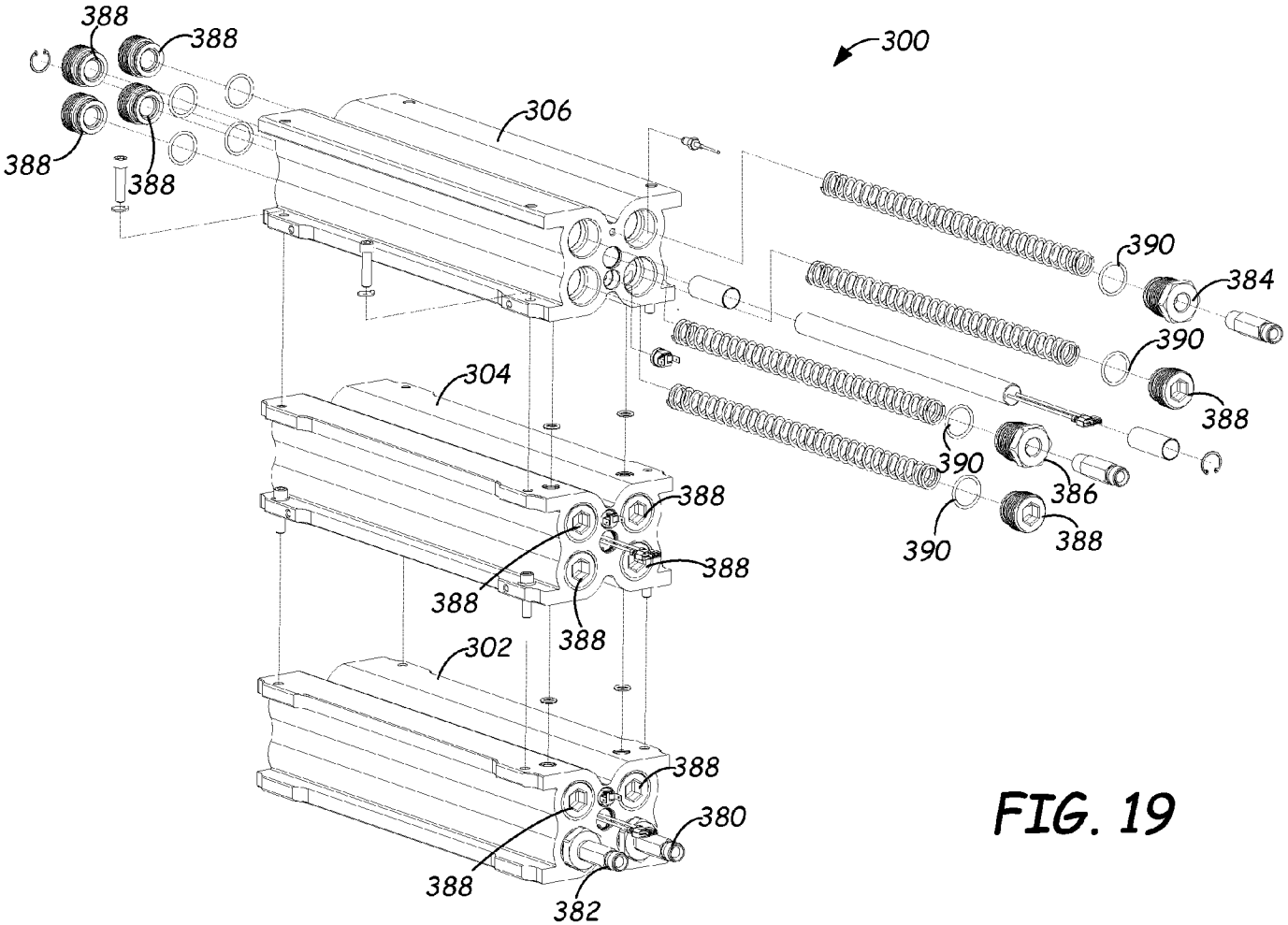
FIG. 19 is a partially exploded perspective view of the heater assembly of FIG. 11.

FIG. 19 is a partially exploded perspective view of assembly 300. As illustrated, inlet connectors 380 and 382 are provided on module 302 and outlet connectors 384 and 386 are provided on module 306. Plugs 388 are provided at the ends of bores that do not have connectors 380, 382, 384, or 386. O-rings 390 are provided for sealing the interface between the modules and connectors or plugs.

Figure 20:
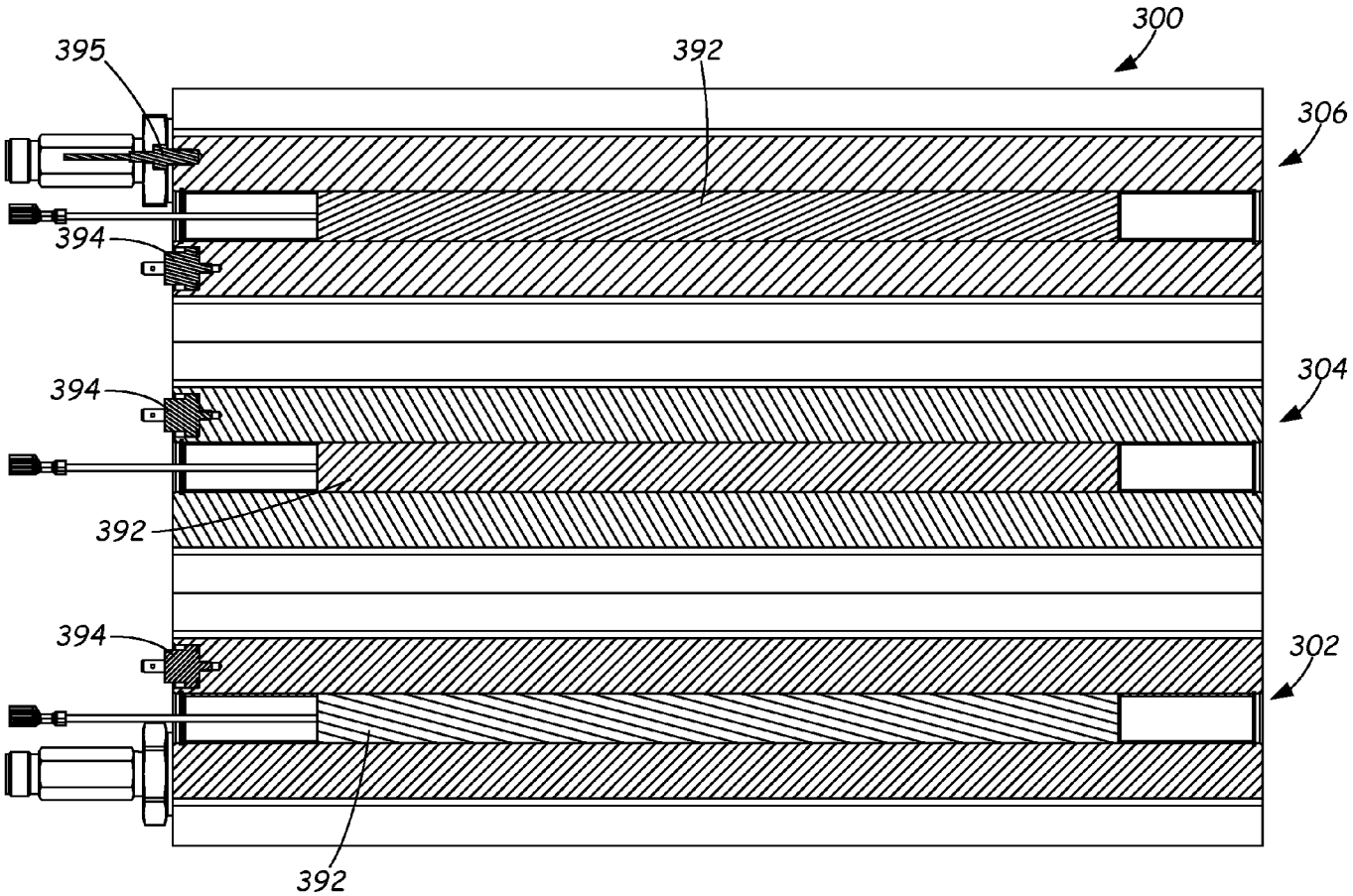
FIG. 20 is a side sectional view of the heater assembly of FIG. 11 taken at line 20-20 shown in FIG. 14.

FIG. 20 is a side sectional view of heater assembly 300 taken at line 20-20 shown in FIG. 14. As illustrated, each module 302, 304, and 306 has a heating element receptacle in the form of a centrally located bore that is configured to receive a heating element 392. At least one of the modules can include a thermocouple 395 that sends a signal to a controller, such as heater controller 122. Additionally, each heater module 302, 304, and 306 can include an over temperature thermal switch 394. In the event of failure of the thermocouple 395 and/or heater controller (e.g., controller 122), the switches 394 are configured to open the electrical circuit, thus preventing power from going to the heating elements.

Figure 21:
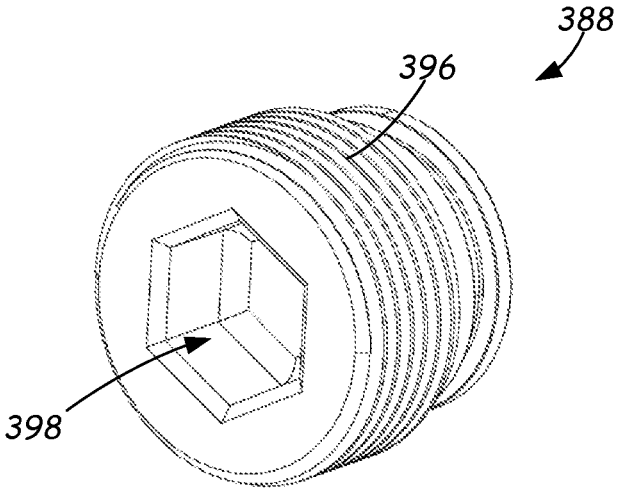
FIGS. 21 and 22 are perspective view of an exemplary plug for a heater module, under one embodiment.
Figure 22:
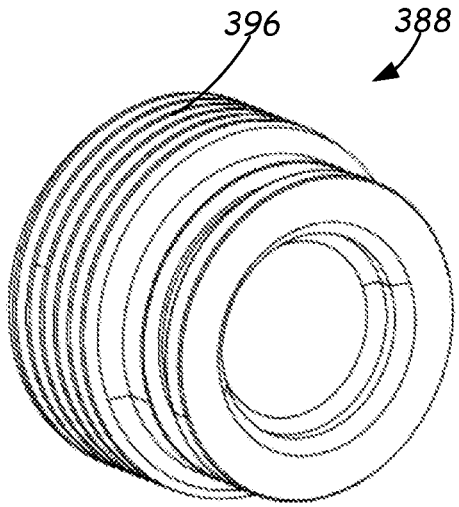

FIGS. 21 and 22 are perspective views of one embodiment of plug 388. Plug 388 has threads 396 and a recessed hexed fitting 398 for receiving a tool for tightening plug 388 into a threaded bore.

Figure 23:
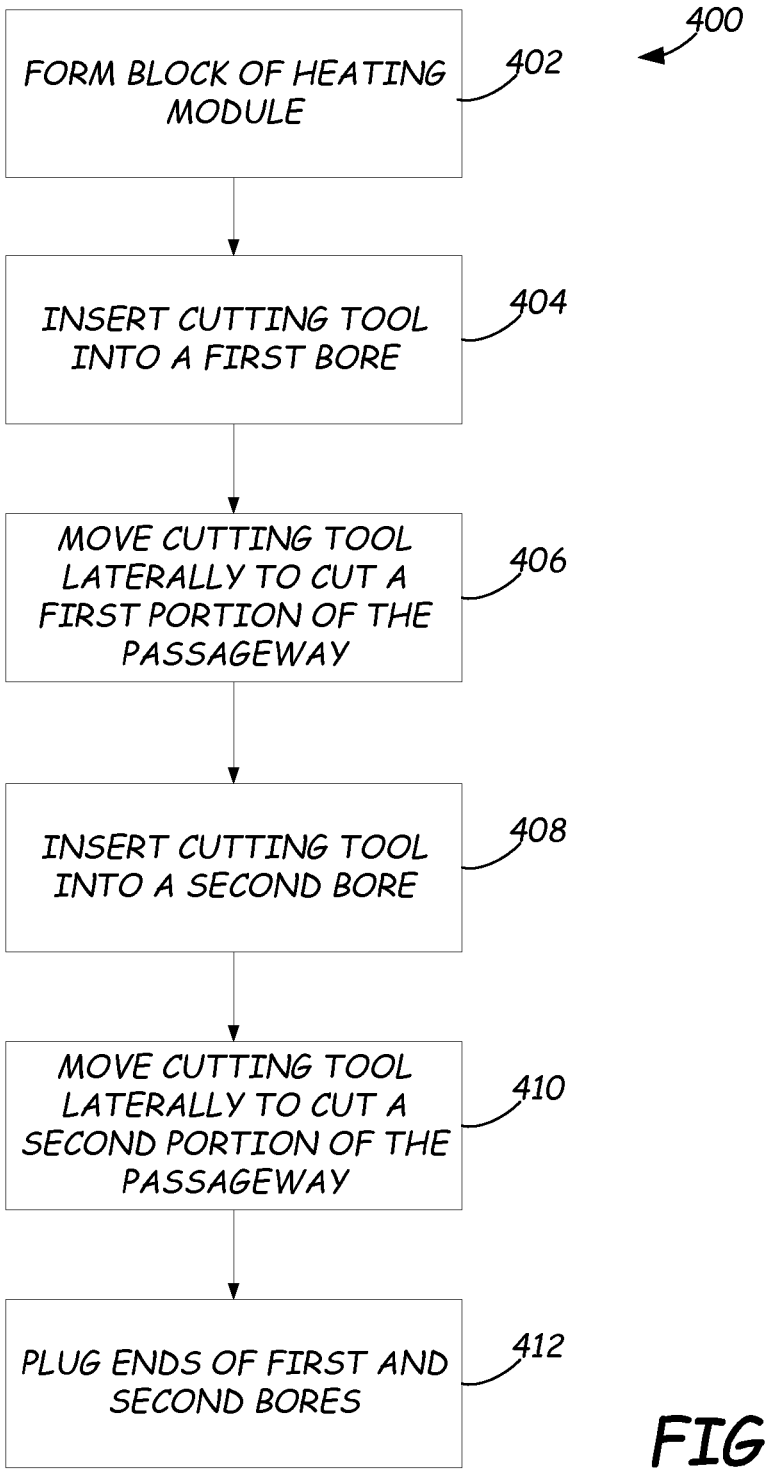
FIG. 23 is a flow diagram illustrating a method of forming a heater module, under one embodiment.

FIG. 23 is a flow diagram of an exemplary method 400 for forming a heater module. For illustration, but not by limitation, method 400 will be described in the context of FIGS. 24 and 25 which are schematic illustrations of an exemplary heater module 414.

At step 402, the heater module 414 is formed, for example using an extrusion process. The module 414 has parallel bores 420 and 422 separated by a material 421 having a thickness 423.

Figure 24:
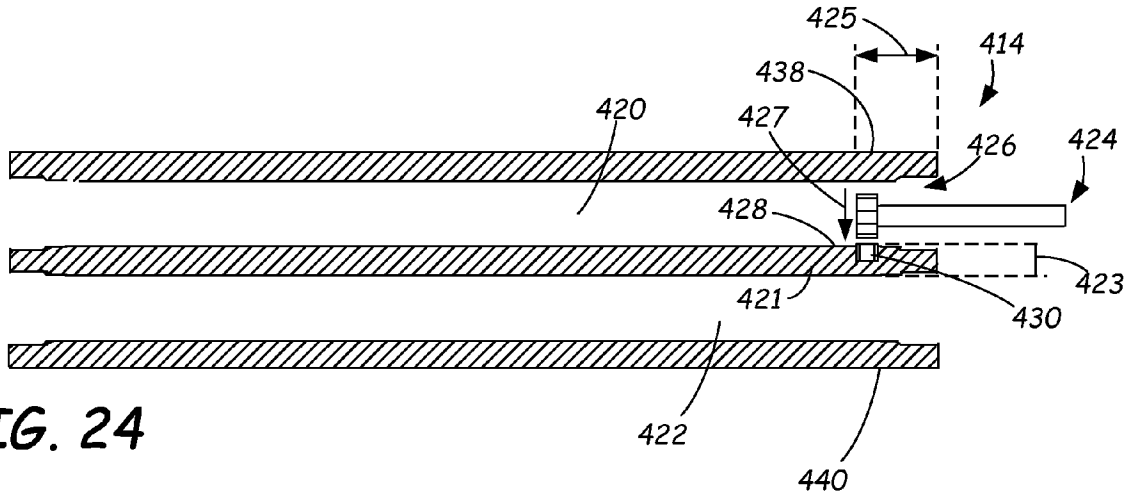
FIGS. 24 and 25 illustrate an exemplary heater module formed with the method of FIG. 23, under one embodiment.

At step 404, a cutting tool is inserted into a first one of the bores. For example, as illustrated in FIG. 24 a cutting tool 424, such as a woodruff or key cutter, is inserted a distance 425 into end 426 of bore 420.

At step 406, the cutting tool 424 is moved laterally (represented by arrow 427) into a surface 428 to cut at least a portion of a passageway between bores 420 and 422. In one example, step 406 can comprise cutting the entire passageway through material 421. In the illustrated example, step 406 comprises cutting a first portion 430 of the passageway between bores 420 and 422.

Figure 25:
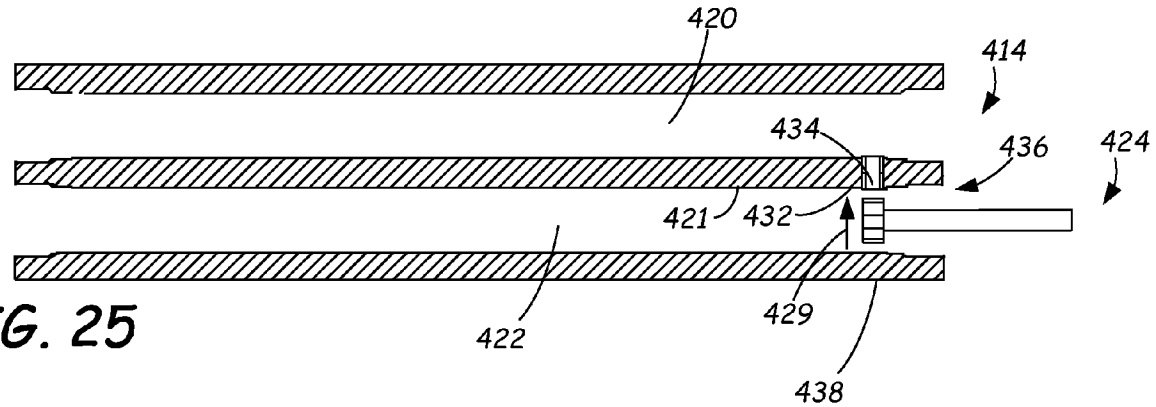

Then the cutting tool 424 is removed from the first bore 420 and, at step 408, the cutting tool 424 is inserted into the second bore 422. As illustrated in FIG. 25, cutting tool 424 is inserted distance 425 into end 436 of bore 422.

At step 410, the cutting tool 424 is moved laterally (represented by arrow 429) into a surface 432 to cut a second portion 434 of the passageway. The first and second passageway portions 430 and 434 connect to form the passageway between bores 420 and 422. Steps 404, 406, 408, and 410 can be repeated for additional bores that are to be connected for fluid transfer.

At step 412, the ends 426 and 436 of bores 420 and 422 are closed using, for example, plugs 388 illustrated in FIG. 21. Method 400 advantageously creates a passageway between bores 420 and 422 without requiring a cross-drilled passageway into block 438 of the heater module. By way of example, an alternative method for forming a passageway comprises drilling from an exterior surface 440 to form the passageway, which would require that the cross-drilled hole in surface 440 be sealed.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A plural component heater assembly comprising:

a plurality of heater modules each having a first set of bores forming a first component flow path configured to allow a first component to flow in a first direction and a second, opposite, direction through the first component flow path and further having a second set of bores forming a second component flow path separate from the first component flow path configured to allow a second component to flow in the first direction and in the second direction through the second component flow path; and at least one heating element receptacle configured to receive a heating element for heating the first and second component paths.

2. The plural component heater assembly of claim 1, wherein each of the heater modules comprises:

at least two bores from the first set of bores forming a portion of the first component flow path; and at least two bores from the second set of bores forming a portion of the second flow component path.

3. The plural component heater assembly of claim 1, wherein the first set of bores and the second set of bores are substantially parallel.

4. The plural component heater assembly of claim 1, wherein the first set of bores of adjacent heater modules are fluidically coupled using a first port to form the first component flow path and the second set of bores of adjacent heater modules are fluidically coupled using a second port to form the second component flow path.

5. The plural component heater assembly of claim 1, wherein the plurality of heater modules comprises at least two heater modules in a stacked configuration.

6. The plural component heater assembly of claim 5, wherein the stacked configuration is extensible by adding additional heater modules to the stacked configuration.

7. The plural component heater assembly of claim 1, wherein each heater module comprises a heating element receptacle that is centrally located between the first set of bores and the second set of bores formed in the heater module.

8. The plural component heater assembly of claim 1, and further comprising:

a heater assembly housing having a pair of opposed sidewalls configured to support the heater assembly.

9. A method of forming a heater module having a first, second, third, and fourth bore separated by a material, the method comprising:

forming the heater module using an extrusion process;

inserting a cutting tool into an end of the first bore;

creating a first passageway between the first bore and the second bore by moving the cutting tool toward the second bore to remove at least a first portion of the material, forming a first component flow path configured to allow a first component to flow in a first direction through the first bore and a second, opposite, direction through the second bore;

inserting a cutting tool into an end of the third bore; and creating a second passageway between the third bore and the fourth bore by moving the cutting tool toward the fourth bore to remove at least a second portion of the material, forming a second component flow path configured to allow a second component to flow in the first direction through the third bore and the second direction through the fourth bore.

10. The method of claim 9, wherein the first, second, third, and fourth bores are substantially parallel.

11. The method of claim 9, wherein moving the cutting tool toward the second bore removes a first portion of the material, and wherein creating the passageway further comprises:

inserting the cutting tool into an end of the second bore; and moving the cutting tool toward the first bore to remove a third portion of the material.

12. The method of claim 9, wherein the cutting tool comprises a woodruff or key cutter.

13. The plural component heater assembly of claim 1, wherein the first set of bores includes a first bore and a second bore for each heater module from the plurality of heater modules and the second set of bores includes a third bore and a fourth bore for each heater module from the plurality of heater modules.

14. The plural component heater assembly of claim 13, wherein the plurality of heater modules have a first end and a second end.

15. The plural component heater assembly of claim 14, further comprising:

a first set of openings connecting the first bore and the second bore at the first end of the plurality of heater modules; and a second set of openings connecting the third bore and the fourth bore at the first end of the plurality of heater modules.

16. The plural component heater assembly of claim 15, wherein each heater module includes:

a first inlet port coupled to the second bore at the second end; and a second inlet port coupled to the fourth bore at the second end.

17. The plural component heater assembly of claim 16, wherein each heater module includes:

a first outlet port coupled to the first bored at the second end; and a second outlet port coupled to the third bore at the second end.

18. The plural component heater assembly of claim 17, wherein each inlet and outlet port includes a recess configured to hold a seal at an interface between each heater module from the plurality of heater modules.

19. The plural component heater assembly of claim 18, wherein each heater module from the plurality of heater modules includes a heating element receptacle that is centrally located between the first set of bores and the second set of bores and each heating element receptacle is configured to receive a heating element for heating the first and second component paths.

* * * * *